US006234467B1

(12) United States Patent
Runzi

(10) Patent No.: US 6,234,467 B1
(45) Date of Patent: May 22, 2001

(54) APPARATUS FOR STACKING AND SORTING PRINTED DOCUMENTS AND FEEDING THEM TO A FINISHING MACHINE

(76) Inventor: Kurt Runzi, Kusnachterstrasse 59, CH-8126 Zumikon (CH)

( * ) Notice: Subject to any disclaimer, the term of this patent is extended or adjusted under 35 U.S.C. 154(b) by 0 days.

(21) Appl. No.: 09/184,590

(22) Filed: Nov. 3, 1998

Related U.S. Application Data

(60) Provisional application No. 60/065,017, filed on Nov. 10, 1997.

(51) Int. Cl.[7] ..... B65H 33/04

(52) U.S. Cl. ..... 270/58; 414/789.9; 414/789.2; 414/792.2; 414/766; 270/58.07

(58) Field of Search ..... 414/789.2, 789.3, 414/789.5, 792.8, 792.7, 792.2, 792.3, 792.4, 789.9, 766, 767; 270/58, 58.07

(56) References Cited

U.S. PATENT DOCUMENTS

| | | | | |
|---|---|---|---|---|
| 2,776,831 | * | 1/1957 | Shields . | |
| 2,865,517 | | 12/1958 | Alford . | |
| 3,039,635 | * | 6/1962 | Prackett et al. . | |
| 3,142,388 | | 7/1964 | Cole . | |
| 3,724,640 | * | 4/1973 | Rapparlie | 414/790.4 |
| 3,738,519 | * | 6/1973 | Edwards | 414/620 |
| 4,173,428 | * | 11/1979 | Thornberg | 414/766 |
| 4,462,735 | * | 7/1984 | Bain et al. | 414/788.8 |
| 4,548,397 | * | 10/1985 | Runzi | 271/121 |
| 4,601,394 | * | 7/1986 | Hutner | 209/3.3 |
| 4,787,810 | * | 11/1988 | Cawley et al. | 414/591 |
| 4,977,827 | * | 12/1990 | Chandhoke et al. | 100/7 |
| 5,061,233 | * | 10/1991 | Schultz et al. | 493/410 |
| 5,069,598 | * | 12/1991 | Kleinhen et al. | 414/790 |
| 5,114,137 | * | 5/1992 | Olson | 271/251 |
| 5,263,701 | * | 11/1993 | Kleinhen | 271/145 |
| 5,322,496 | * | 6/1994 | Ernst et al. | 493/410 |
| 5,413,449 | * | 5/1995 | Schoenherr et al. | 414/343 |
| 5,429,249 | * | 7/1995 | Belec et al. | 209/584 |
| 5,439,209 | * | 8/1995 | Runzi | 271/251 |
| 5,464,099 | * | 11/1995 | Stevens et al. | 209/3.1 |
| 5,556,254 | | 9/1996 | Darcy et al. . | |
| 5,692,999 | * | 12/1997 | Crowley et al. | 493/416 |
| 5,695,313 | * | 12/1997 | Gross et al. | 414/793.4 |
| 5,775,872 | * | 7/1998 | Seidl et al. | 414/789.5 |
| 5,820,334 | | 10/1998 | Darcy et al. . | |

FOREIGN PATENT DOCUMENTS

| | | |
|---|---|---|
| 2592640 | 7/1987 | (FR) . |
| 8002831 | 12/1980 | (WO) . |
| 96 40575 | 12/1996 | (WO) . |
| 9640575 | 12/1996 | (WO) . |

* cited by examiner

*Primary Examiner*—Robert P. Olszewski
*Assistant Examiner*—Richard Ridley
(74) *Attorney, Agent, or Firm*—Browdy & Neimark

(57) ABSTRACT

The apparatus comprises a conveyor (2) for feeding paper sheets into a cassette (4) in a stacker (2). The conveyor (2) can be switched between two positions such that successive documents are separated from one another by a lateral shift. The cassette (4) is lowered in the stacker (3) as the stack builds up. After the stack is completed the cassette (4) is turned by 180°, removed from the stacker (3) and inserted into a sorter (6). The sorter (6) picks up the documents one by one and pushes them onto a conveyor (7) which transports them to a finishing machine (8).

11 Claims, 7 Drawing Sheets

APPARATUS FOR STACKING AND SORTING PRINTED DOCUMENTS AND FEEDING THEM TO A FINISHING MACHINE

This application claims the benefit of U.S. provisional application No. 60/065,017, filed Nov. 10, 1997.

FIELD OF THE INVENTION

The present invention concerns an apparatus for sorting printed documents consisting of at least one page and feeding the documents to a finishing machine.

BACKGROUND ART

In U.S. Pat. No. 5,439,209 to Kurt Rünzi a paper stacking apparatus is disclosed which is capable of separating successive documents or jobs on the stack being formed. The apparatus has a conveyor belt for transporting the individual sheets to a stacker. A holder is arranged above the conveyor belt. The holder holds a row of freely rotatable balls which press the sheets onto the belt. On one side of the belt a guide rail is arranged which is pivotable about its rear end between two pivot positions. In both positions the belt converges towards the guide rail in the transport direction. The guide rail is switched to its other position each time the last page of a document printed has passed the conveyor. Thereby, the documents are separated from one another on the stack being formed by a lateral shift. This way the individual documents can easily be separated from one another in a following operation. Presently, this separation is performed manually. This U.S. patent is declared an integral part of the present application.

In modern high speed printing machines, e.g. laser printers, the individual papers of the successive documents or jobs are printed in successive order of their page number and outputted with their printed side down. The printed papers are stacked in a stacker. The sheets of the individual documents are then in correct order.

SUMMARY OF THE INVENTION

The aim of the present invention is to improve the handling of such stacked and separated documents.

In a first aspect the present invention concerns an apparatus for stacking printed documents consisting of at least one sheet of paper. The apparatus comprises conveying means for conveying the sheets from an input end to an output end. Deflecting means are associated with the conveying means for laterally deflecting the sheets as they pass from the input to the output end. The deflecting means are switchable between two positions. A stacker is arranged at the output end and contains a sled which is vertically displaceable in vertical guide rails of a stand. A first motor is provided for lifting and lowering the sled. A carriage is pivotably mounted on the sled for pivoting about a horizontal axis by means of a second motor. An exchangeable cassette is inserted into the carriage. The cassette has a rear wall and two opposite side walls. In the initial position of the carriage, as the stack is being formed, the cassette has a removable bottom plate and a top plate which is placed on the stack when the latter is finished. The top plate is arrestable at a plurality of levels. A pusher is mounted on the stand to push the inserted top plate against the stack.

In a second aspect the present invention concerns the apparatus for sorting printed documents consisting of at least one sheet of paper each. The apparatus comprises a conveying means for transporting the documents. A holder is arranged upstream of the conveying means. A sled is displaceably mounted in the holder for movement in a vertical direction by means of a first motor. An exchangeable cassette is mounted in the sled. The cassette contains a stack of documents which are separated from one another by a lateral shift between each successive document. The shifts alternate such that the stack is substantially vertical. Two lifting means are disposed on either side of the cassette which can act on one side of the stack between the topmost document and the next lower one and lift the topmost document. Each of the two lifting means is pivotable by a separate second motor. At least one pusher is arranged for pushing the lifted document to the conveying means. A sensor which is connected to a controller is arranged for controlling the height position of the stack relative to the lifting means.

BRIEF DESCRIPTION OF THE DRAWINGS

A preferred embodiment of the invention is hereinafter described in reference to the drawings, in which.

DETAILED DESCRIPTION OF AN EMBODIMENT

Figure 1:
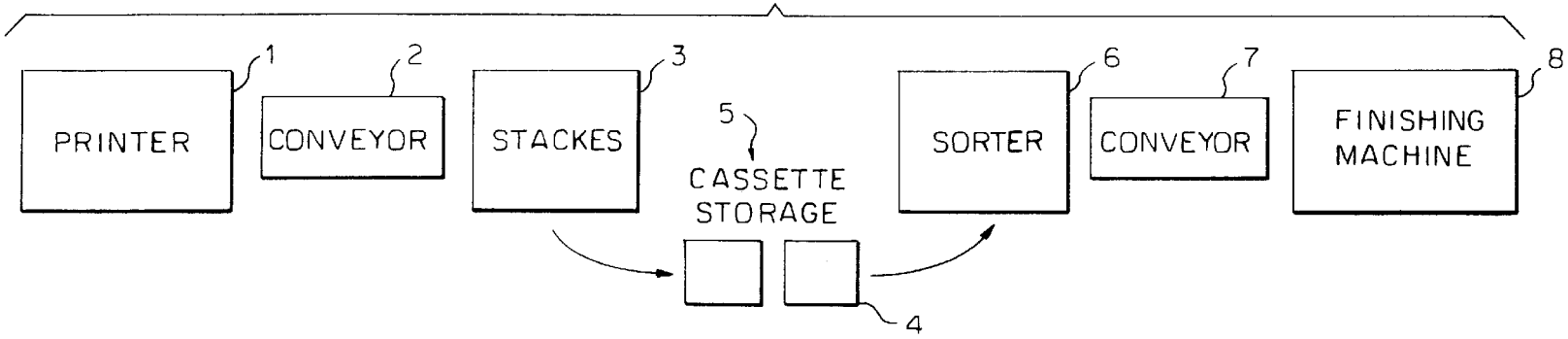
FIG. 1 shows a diagrammatic arrangement of the apparatus according to the present invention.

FIG. 1 shows a diagrammatic arrangement of an apparatus according to the present invention. Printed sheets of paper exit from a high speed printer 1 and are conveyed by a conveyor 2 to a stacker 3 where the papers are stacked separated into individual documents in a cassette 4. When a cassette 4 is full it is removed from the stacker, stored in a cassette storage 5 and replaced by an empty cassette, whereupon printing is resumed. From the storage 5 a selected cassette 4 is picked up and placed into a sorter 6 which picks up the documents one by one and pushes them onto a conveyor 7 which transports them to a finishing machine 8 which may be a binder and/or folder and/or envelope stuffer and sealer or the like. A method of operating this system is disclosed in the copending U.S. patent application No. 60/065,018 to William H. Gunther entitled "Method of sorting printed documents and feeding them to a finishing machine", filed on Nov. 10, 1997, and its related U.S. and EP patent applications, which are incorporated herein by reference.

Figure 2:
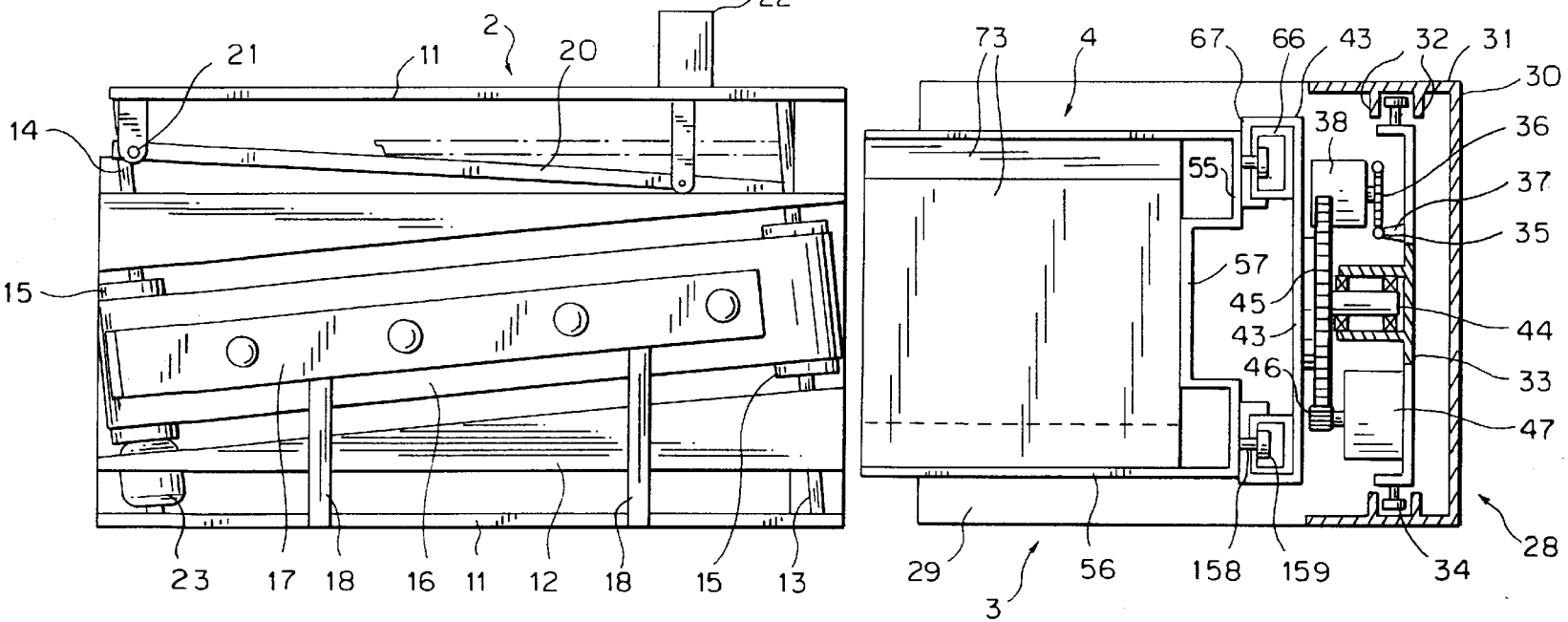
FIG. 2 shows a top view of a stacker, partially in cross section.

FIG. 2 shows a top view of the conveyor 2 and stacker 3. The conveyor 2 is more fully disclosed in U.S. Pat. No. 5,439,209. It comprises a frame 11 which holds a sliding plate 12. Two axles 13, 14 are rotatably mounted in the frame 11 and support rollers 15 around which an endless belt 16 travels. The top surface of the upper run of the belt 16 is flush with the upper surface of the sliding plate 12. The belt 16 is slightly inclined with respect to the longitudinal extension of the frame 11. A holder plate 17 is attached to the frame 11 by two bars 18 and extends parallel and above the belt 16. A row of freely rotatable balls 19 is held in the plate 17. The balls 19 rest on the belt 16 or a sheet transported on it and press the sheet by gravity against the belt 16. A lateral guide rail 20 is disposed on one side of the plate 12. The rail 20 is pivotable about a vertical axis 21 at its upstream end and is actuated by an actuator 22 between two positions shown in solid and dash-dotted lines. In both positions the belt 16 converges towards the rail 20 in the traveling direction. The belt 16 is driven by a motor 23.

The stacker 3 comprises a stand 28 with a bottom plate 29 and a U-shaped vertical housing 30. The two lateral sides 31 of the housing have vertical guide rails 32. A sled 33 is guided in the rails 32 for vertical movement by rollers 34 rotatably mounted on the sled 33. The sled 33 is carried by an endless chain 35 which is trained around two sprocket wheels 36 rotatably mounted at the upper and lower end of the frame 30. The sled 33 is fastened to one run of the chain 35 by means of a stud 37. The chain 35 is driven by a reversible gear motor 38.

A plate shaped carriage 43 is rotatably mounted on the sled 33 for rotating about the axis 42 of a horizontal axle 44. On the front side of the sled 33 a gear wheel 45 is mounted on the axle 44 which meshes with a pinion 46 driven by a gear motor 47 which is supported by the sled 33. A sensor 48 on the sled 33 cooperates with two marks 49 on the carriage 43. The marks 49 are diagonally opposed with respect to the axes 42. The sensor 48 is connected to a controller (not shown) which stops the motor 47 when one of the marks 49 is sensed. The carriage 43 can therefore be turned in steps of 180° about the axis 42.

The cassette 4 is exchangeably mounted to the carriage 43. The cassette 4 has a rear wall 55 and two side walls 56. The rear wall 55 has a U-shaped indentation with a plane front side which forms a stop 57 for the sheets of paper as they are fed into the cassette. A first plate 59 is removably mounted to the side walls 56 adjacent one end thereof. After a stack 60 has been completed in the cassette 4, a second plate 61 (shown in dash-dotted lines in FIG. 3) is inserted between the side walls 56. The second plate 61 has spring loaded latches on all four corners which each latch into one rectangular hole 62 of two rows 63 of holes in both side walls 56. After the plate 61 is inserted above the stack 60 the sled 33 is moved upwards by the motor 38 until the plate 61 abuts against a stop 64 mounted on the stand 28. The stop 64 compresses the stack 60. When the current driving the motor 38 reaches an adjustable limit, the motor 47 is reversed and the sled 33 moved downwards about to its middle position. By means of the latches on the plate 61 the stack 60 remains compressed. The carriage 43 can now be turned by 180° by the motor 47. The sled 33 is then moved to its lowermost position.

The cassette 4 is locked on the carriage 43 by two rectangular pipes 66 which are slideable in the longitudinal extension of the carriage 43 in guides 67 on both ends of the carriage 43. The pipe 66 is spring loaded into its locking position in which a free end 68 of the pipe 66 projects beyond one end (in FIG. 3 the upper end) of the carriage 43. When the carriage 43 is turned by 180° and lowered to its lowermost position, the two pipes 66 abut against two stops 69 fixed to the base plate 29 and are pushed in. That way the cassette 4 is unlocked and can be removed from the carriage 43. To facilitate removal, an endless belt 70 is mounted on a row of freely rotatable rollers 71. The cassette 4 is removed laterally so that the stacker 3 can remain in place when changing cassettes.

A new cassette 4 is inserted with the plate 59 on the upper side. Then the sled 33 is lifted to its middle position and the carriage 43 turned around by 180°. The sled 33 is then further lifted such that the upper surface of the plate 59 is slightly below the upper run of the belt 16. This is controlled by the controller (not shown) in response to the signal of a sensor 72, e.g. a proximity sensor or a light barrier.

The printer 1 is now started by the central controller. The rail 20 is in its initial position shown in solid line in FIG. 2. The first series of sheets printed, e.g. the first document 73 or job, is therefore deposited in the cassette adjacent its right side wall 56. The sheets are fed to the conveyor 2 with their printed side down. After the last sheet of the first document has passed the guide rail 20 it is switched to its other position so that the next document 73 is deposited in the cassette 4 adjacent its left side wall whereupon the rail 20 is switched back to its initial position. Thereby, each successive document 87 is separate from the preceding one by a lateral shift. As mentioned above when the stack 60 is completed, it is compressed by insertion of the plate 61 and movement of the sled 33 against the stop 64. Therefore, when turning the carriage 43 by 180° the lateral shift between successive documents 73 is maintained. The first printed document 73 is now on top of the stack 60.

Figure 3:
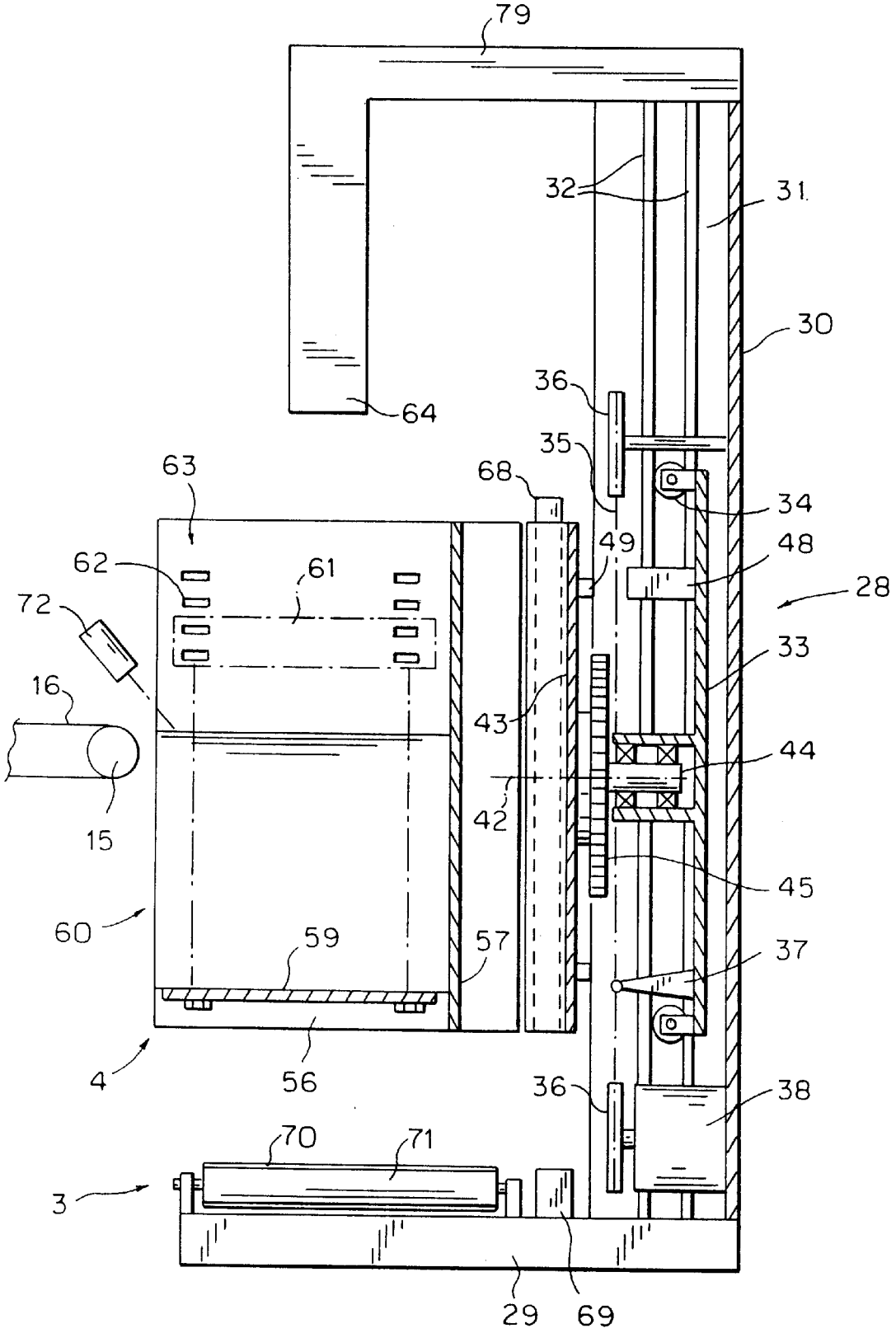
FIG. 3 shows a vertical cross section through the stacker.
Figure 4:
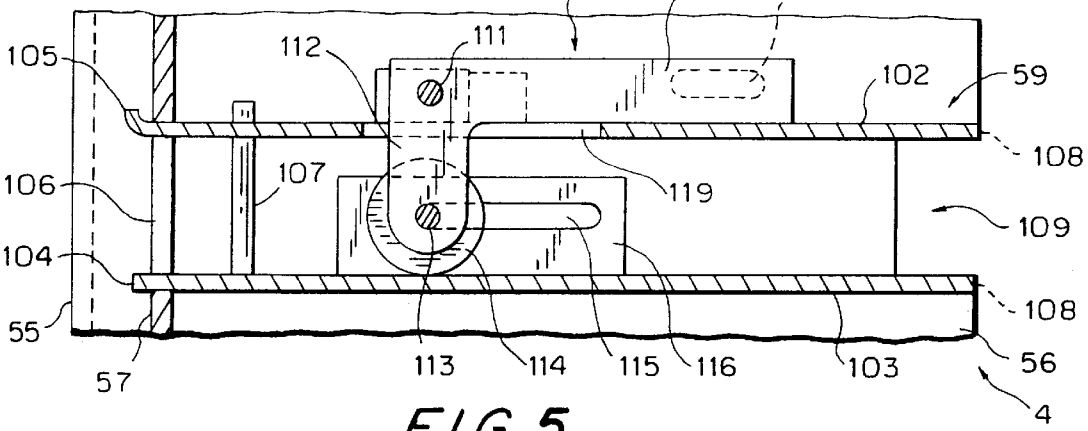

FIG. 4 shows, in an enlarged scale, the latching mechanism of the first plate 59, which is the bottom plate in the position of FIG. 3, but the top plate in FIG. 4. The plate 59 comprises two boards 102, 103 of sheet metal. Both boards 102, 103 have two rectangular extensions 104, 105 which extend through two rectangular slots 106 in the stop 57 of the rear wall 55. Several guide studs 107 are mounted on the board 103 and extend through corresponding holes in the board 102. On the front end, two rectangular ears 108 extend laterally from the boards 102, 103 beyond the outer surface of the two side walls 56 into rectangular slots 109 in the walls 56 which are on the same height as the slots 106, have the same width and are open to the front side. Two laterally spaced, identical, L-shaped levers 110 are mounted on a shaft 11 pivotably mounted to the board 102. The lower arms 112 of the levers 110 carry a common axle 113 on which two rollers 114 are rotatably mounted. The axle 113 traverses a horizontal elongated hole 115 in two plates 116 attached to board 103. The second arms 117 of the levers 110 are interconnected by a handle bar 118 for actuating the levers 110. The arms 112 extend through slots 119 of the board 102.

In the position shown in FIG. 4 the plate 59 is locked in the cassette 4. The arm 117 rests against the outside of the board 102 and the rolls 114 are slightly beyond the dead center, i.e. the axle 113 is slightly left of the shaft 111. The boards 102, 103 are slightly elastically deformed by the pressure of the rollers 114. The extensions 104, 105 and the ears 108 are pressed against the top and bottom surfaces of the slots 106, 109. When lifting the handle 118 the axle 113 guided in the holes 115 moves the boards 102, 103 towards one another and the plate 59 is unlocked and can be removed. The relatively large stroke provided by the disclosed latching mechanism is advantageous, when high stacks 60 are to be handled in the cassette 4 because the stack 60 has to be decompressed before the plate 59 can be removed.

Figure 5:
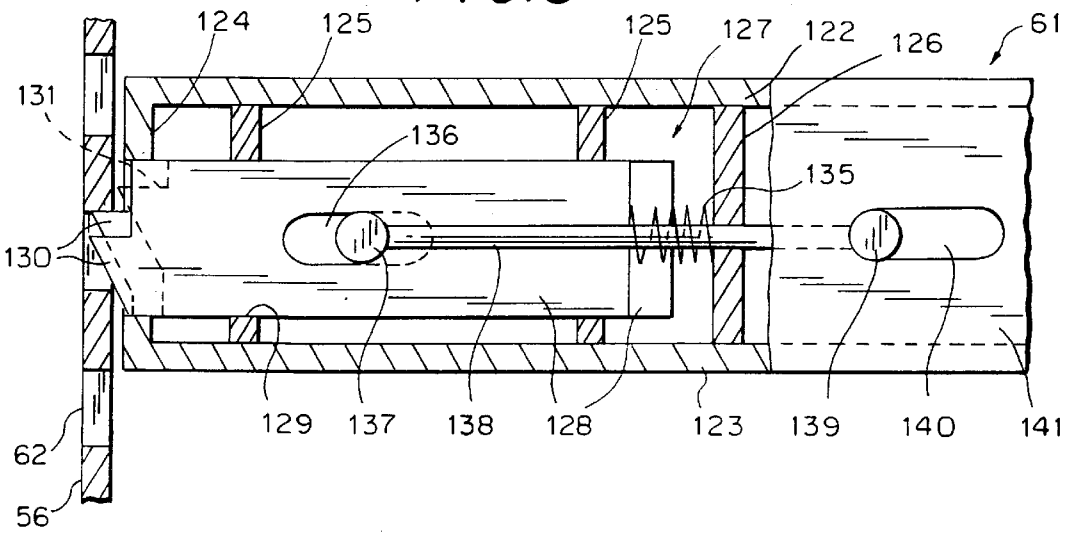

FIG. 5 shows the latching of the plate 61 in an enlarged scale. The plate 61 comprises two boards 122, 123 which are fastened together by end walls 124 and intermediate walls 125, 126. On all four corners of the plate 61 a latching mechanism 127 is disposed. Each mechanism 127 consists of three or more plate-shaped, basically rectangular sleds 128 which are slideably guided in three rectangular vertical slots 129 arranged next to each other in the walls 125. A saw tooth-shaped latch 130 extends from each sled 128 towards the side wall 56. The upper, horizontal surface 131 of the latches 130 of each mechanism 127 are staggered such that the vertical distance between the surfaces 131 of successive latches 130 is about ⅓ of the spacing between adjacent openings 62 in the side walls 56 (not drawn to scale in FIG. 5).

Each sled 128 is preloaded outwards by a separate spring 135 for engagement of the latches 130 with the openings 62. The sleds 128 have an elongated hole 136 which is traversed by a common horizontal rod 137. The rod 137 is parallel to the wall 56 and the boards 122, 123 and is attached to a bar 138. The bar 138 (shown in front of the sleds 128) is guided in the walls 125, 126. At its free end a handle 139 extends laterally through an elongated hole 140 in the front and rear wall 141 of the plate 61. By pulling the handle 139 all three sleds 128 of the respective mechanism 127 can be pulled in simultaneously. Instead of the handles 139 a common actuating mechanism could be connected to all four bars 138. A higher number of sleds 128 with a smaller difference of height of the surfaces 131 may be used in cases where the cassettes 4 should store smaller stacks which are less compressible.

Figure 6:
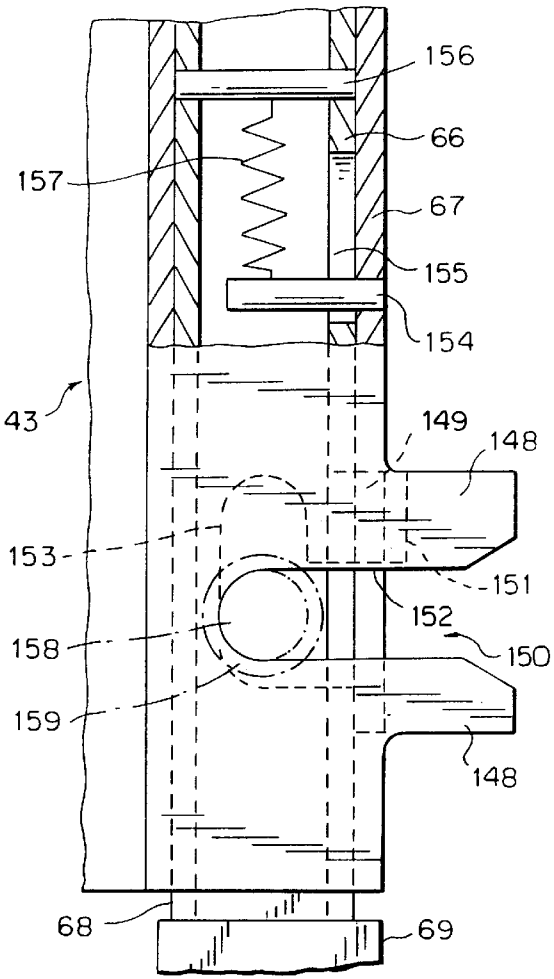
FIGS. 4 to 6 show details of the stacker in an enlarged scale.

In FIG. 6 the latching mechanism for the cassettes 4 is shown as a front view of the lower bottom part of the representation in FIG. 2 but with the carriage 43 turned 180°, partly in cross section. Each guide 67 at its lower and upper end has two ears 148 extending laterally which are formed from the same sheet metal as the carriage 43 by forming cutouts 149 in the sides of the guide 67. All ears 148 extend in the same direction. A slot 150 which widens towards the free end of the ears 148 extends horizontally over the middle of the pipe 66. The pipe 66 has a similarly formed ear 151 which extends laterally through the upper cutout 149. The pipe 66 has a laterally open slot 152 which is wider than the slot 150. In the middle of the pipe 66 a vertical slot 153 extends from the slot 152. On the guide 67 a bar 154 is attached which extends into the pipe 66 through an elongated hole 155. Above the bar 154 a crossbar 156 crosses the pipe 66. A preloaded spring 157 is fastened to the bars 154, 156 which forces the pipe 66 downwards in the representation of FIG. 6. The preload force is larger than the weight of the pipe 66.

When the free end 68 of the pipe 66 is lifted off the stop 69, the pipe 66 is lowered relative to the guide 67 by gravity and spring force so that the slot 153 comes into engagement with a bar 158 attached to the rear wall 55 of the cassette 4 (shown in dash-dotted lines in FIG. 6) and grips in front of a flange 159 at the free end of the bar 158 (see also FIG. 2). That way the cassette 4 is locked on the carriage 43 on all four corners and can safely be turned.

A proximity or limit switch may be associated with each stop 69 to check whether the ends 68 still abut the stops 69 when the sled 33 has lifted a distance corresponding to the width of the slots 150. The various positions of the sled 33, which have to be checked or on which the sled 33 has to stop, may be controlled via the controller by limit switches (not shown). With the signal of the limit switch mentioned above it can therefore be assured that the cassette 4 is safely locked on the carriage 43 before the sled 33 is lifted up further for turning the carriage 43 by 180° C.

Figure 9:
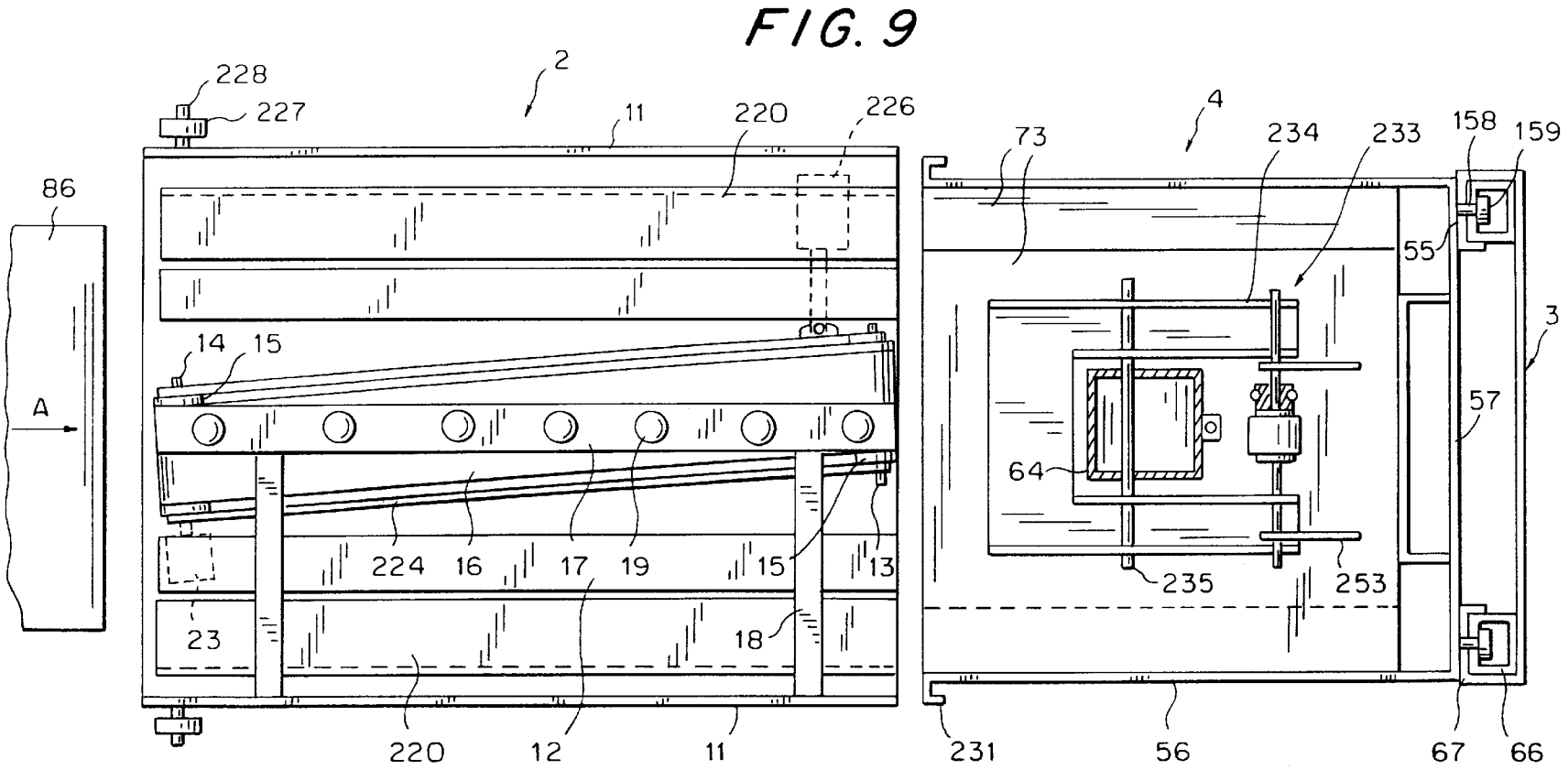
FIG. 9 shows a top view of a second embodiment of the stacker.
Figure 12:
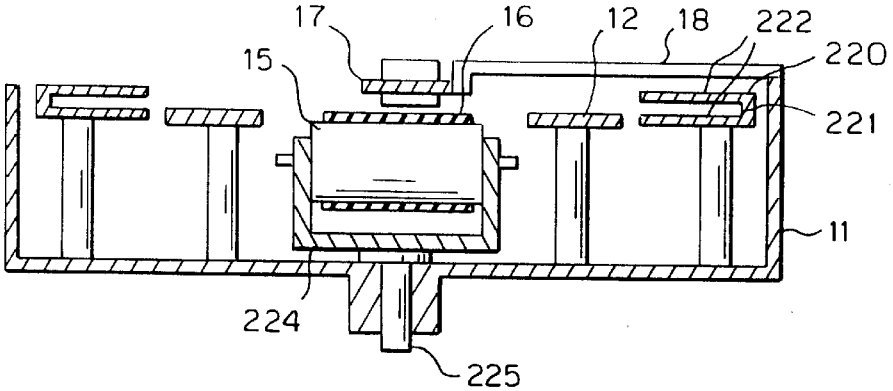

In an alternative embodiment the guide rail 20 is not pivotable about the axis 21 but displaceable laterally parallel to itself, e.g. by means of a parallelogram linkage. The guide rail 20 may be U-shaped in cross section as shown in the embodiment of FIGS. 9 and 12. This has the advantage that buckling of the paper along the guide rail 20 is prevented. The parallel displacement of the guide rail 20 has the advantage that in both of its positions the papers are fed into the cassette 4 with their lateral edges parallel to the side walls 56.

Figure 7:
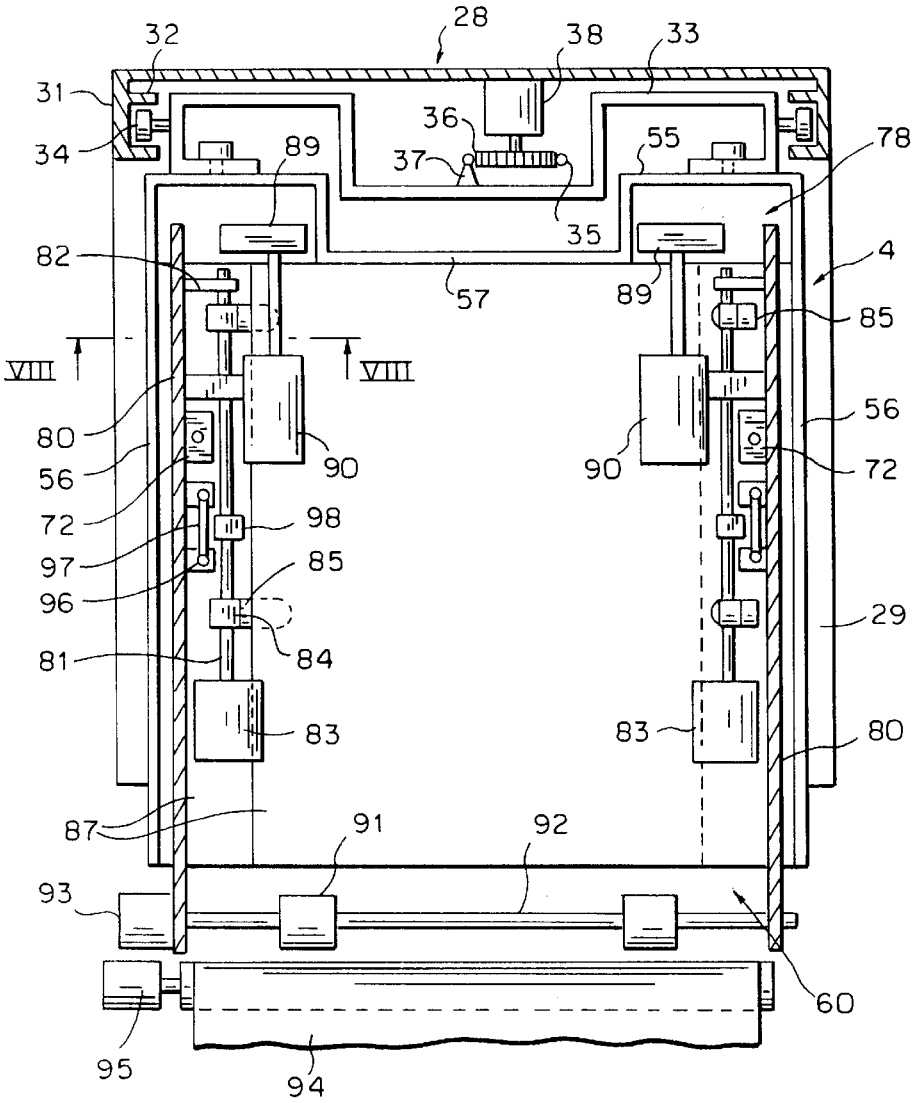
FIG. 7 shows a top view of a sorter, partly in cross section.

The sorter 6 is shown in FIG. 7 as a plan view, partly in cross section. It is similar in construction as the stacker 3 except that instead of the stop 64 a sorting device 78 is mounted on the free end of the L-shaped arm 79 (FIG. 3) of the stand 28. Similar parts are designated with the same reference numerals in FIG. 7 as those in FIGS. 2 and 3 so that a detailed description of those parts is not necessary. The pivotable carriage 43 may be omitted in the sorter 6 so that the cassette 4 is directly attached to the sled 33. The latching mechanism described with reference to FIG. 6 is not required. However, for a small production series it may be more economical to build the sorter 6 identical to the stacker 3 except for the above mentioned difference.

Before a cassette 4 is inserted into the sorter 6 the plate 59, which is on top in this case, is first removed. The sorting device 78 comprises a housing 80. Adjacent each side wall 56 of the inserted cassette 4 a shaft 81 is journaled in bearings 82 supported by the housing 80. The shafts 81 are actuated by respective motors 83 and extend parallel to the side walls 56 and the top surface of the stack 60. Two bushings 84 are mounted on each shaft 81. Each bushing 84 carries an L-shaped finger 85. The tip of the fingers 85 may be rounded and wedged such that they can be inserted between the lowest sheet 86 of the topmost document 87 (FIG. 8*a*) and the next following document. In the sorter 6 one height sensor 72 is mounted on the housing 80 on either side of the stack 60 in the marginal range 88 between the side edges of successive documents. The sensors 72 alternatingly control, via a controller (not shown), the height of the stack 60 such that the topmost sheet of the second document 87 is touched by the fingers 85 during their motion in the marginal range 88 on the side, where the side edge of the topmost document is spaced from the respective side wall 56. When the respective shaft 81 is turned, the tips of the fingers 85 lift the topmost document 87 (shown in dash-dotted lines in FIG. 8*a*). The fingers 85 on the other side of the stack 60 are lifted off the stack 60.

Two rod shaped pushers 96 are mounted slidably to the wall 80 and are interconnected at their upper end by a crossbar 97. In the lifted-off position of the fingers 85 the crossbar 97 is lifted by a lever 98 mounted on the shaft 81.

Figure 8A:
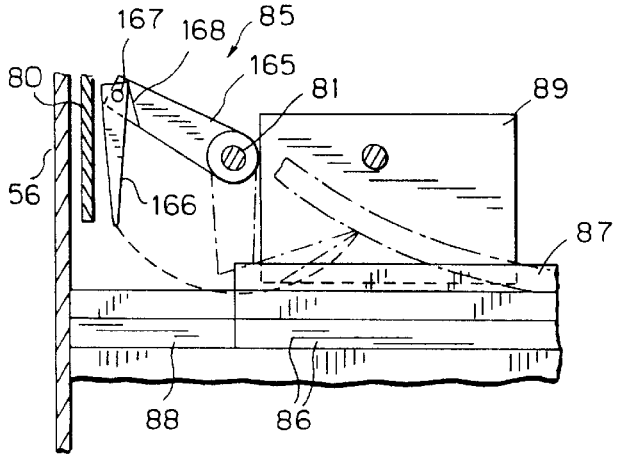
FIGS. 8*a* and 8*b* show the operation of the lifters and the pushers.

In FIG. 8*a* the operation of the fingers 85 is shown in more detail. Each finger 85 consists of a lever 165 fixed to the shaft 81 and an arm 166 pivotably attached to the lever 165 by a pin 167 and spring urged to the position shown in FIG. 8*a* against a stop 168.

Figure 8B:
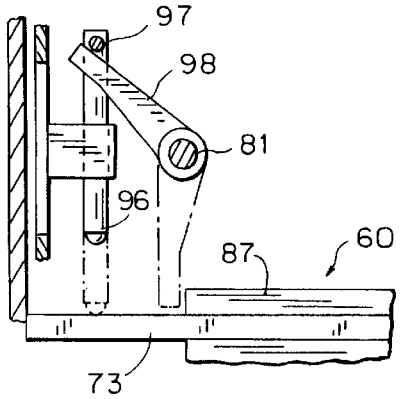

The operation of the lever 98 and the pushers 96 is shown in FIG. 8*b*. In the lifted position of the fingers 85 the lever 98 lifts the crossbar 97 and therewith the pushers 96 of the stack 60. As the fingers 85 are turned to the position shown in dash-dotted lines in FIG. 8*a*, the pushers 96 are lowered and press by gravity against the second but topmost document 87 in the marginal range 88. As there is a gap between that document 73 and the fourth one, its marginal range 88 is slightly pressed down which helps the finger tips to lift all of the sheets of the topmost document 87. In the lowered position the lever 98 is adjacent the side edge of the topmost document 87 which helps guiding it as it is pushed out.

In case the stack 60 contains documents 87 which are all of approximately the same thickness, a single sensor 72 may be arranged above the middle of the stack 60.

When the topmost document 87 is lifted (FIG. 8*a*), a pusher 89 on that side of the stacker is pulled by a respective actuator 90 and pushes that document between two pairs of transport rolls 91 mounted on two shafts 92 rotatably supported in the housing 80 and spring urged against each other. One of the shafts 92 is driven by a motor 93. The rollers 91 transport the document 87 onto a conveyor belt 94 which conveys it to a finishing machine. The belt 94 is driven by a further motor 95. When the topmost document 87 is pushed out by the respective pusher 89, that document is guided by the side wall 56 on the opposite side and the lever 98.

In FIGS. 9 to 12 a second embodiment of the conveyor 2, part of the stacker 3 and part of the cassette 4 are shown. Similar parts are designated with the same reference numerals as in the embodiment of FIGS. 2 to 3 so that a detailed description of those parts is omitted.

In the second embodiment two guide rails 220 (corresponding to rail 20 of FIG. 2) are fixed with respect to the frame 11. They are U-shaped in cross section. A web 221 connects the upper and lower shanks 222 of the rail 220 which are spaced apart by about 1 mm and are funnel shaped at the upstream end. The spacing between the opposing webs 221 is larger than the width of the papers 86 to be stacked. It may be adjustable. The axles 13, 14 of the support rollers 15 and the motor 23 are supported in a U-shaped carrier 224 which is pivotable about a vertical axis 225 in the frame 11 between the position shown in FIG. 9 and a position symmetrical to it with respect to the vertical middle plane of the conveyor 2. The pivoting motion of the carrier 224 is effectuated by an actuator 226. The holder plate 17 with the balls 19 extends along the middle plane of the conveyor 2.

The papers 86 are fed in symmetrical to the rails 220 in the feeding direction A. When the carrier 224 is in the position shown in FIG. 9 the papers 86 are shifted laterally to the left in the conveyor 2 by the inclined belt 16 until their left edge abuts against the web 121 of the left rail 220. Therefore, the papers 86 are fed into the cassette 4 with their side edges parallel to the side walls 56. The left edge of the papers is adjacent the left side wall 56. When the carrier 224 is switched to the other position the paper 86 is fed into the cassette 4 with the right edge adjacent to the right wall 56.

Figure 10:
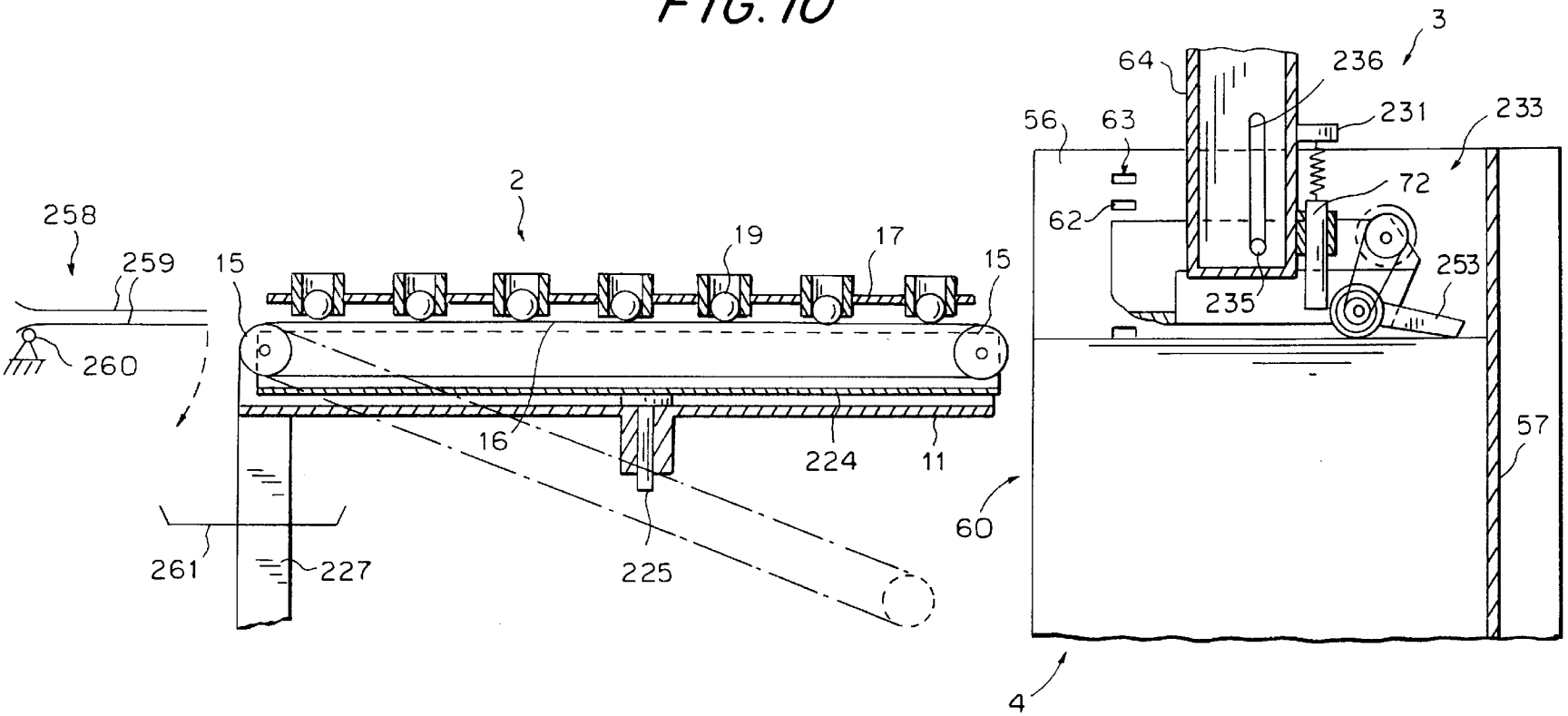
FIG. 10 shows a longitudinal section through the stacker.

In order to facilitate insertion of the second plate 61 (FIGS. 3 and 5) into the cassette 4 after a stack 60 has been completed the frame 11 is pivotably mounted on a stand 227 about a horizontal axis 228 at the upstream end (indicated in dash-dotted lines in FIG. 10).

The cassette 4 of FIGS. 9 and 10 has a U-shaped bending 231 at the forward edge of the side walls 56 to increase its rigidity. The rear wall 55 is through-going and the stop 57 is formed of a U-shaped sheet metal which is welded to the rear wall 55. This construction also increases the strength and torsional stiffness of the cassette 4. The rear rows 63 of rectangular holes 62 are arranged in the rear wall 55 on either side of the stop 57. That way it is avoided that the front edge of a paper 86 can catch on the rear end of one of the rear holes 62.

In the embodiment of FIGS. 9 to 12 the photo-sensor 72 for controlling the vertical movement of the sled 33 (not shown in FIGS. 9 and 10) is mounted vertically displaceable on the stop 64. In operation the lower end of the stop 64 is in close proximity to the stack 60 being formed. The sensor 72 projects beyond the lower side of the stop 64 to get a good resolution. When pressing the stop 64 against the plate 61 (FIG. 5) the sensor 72 is automatically lifted against the force of a spring 232.

Figure 11:
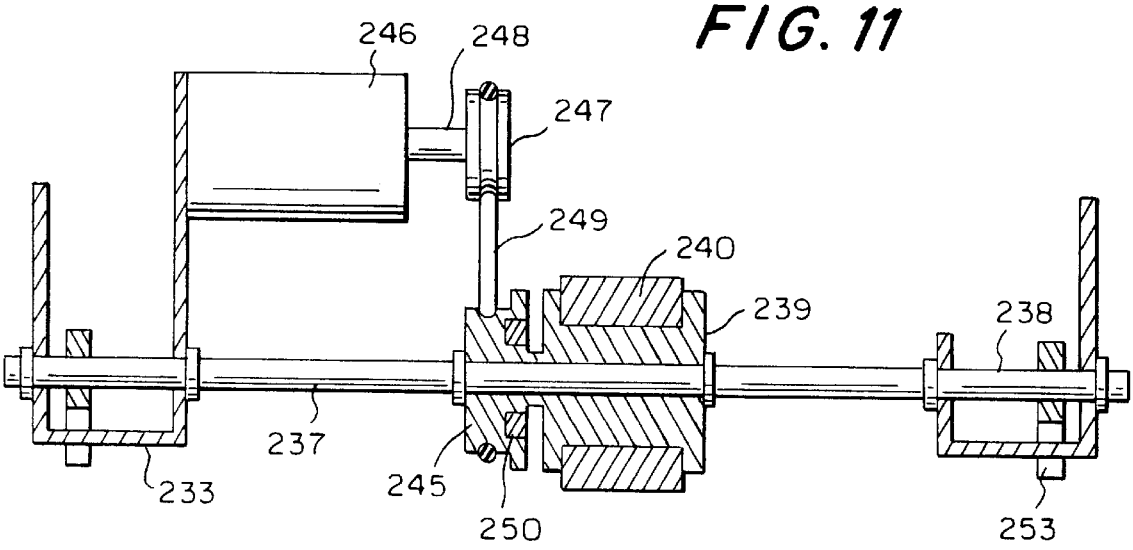
FIGS. 11 and 12 show cross sections.

On the lower end of the stop 64 a transport mechanism 233 is mounted. It comprises a generally U-shaped holder 234 which is pivotably mounted on a horizontal axle 235 which is guided in vertical slots 236 in the side walls of the stop 64. Adjacent the rear end of the holder 234 a transverse axle 237 is mounted (FIG. 11). On the axle 237 a transport wheel 239 is mounted which has an elastomer sleeve 240 in a corresponding groove on its cylindrical periphery.

The wheel 239 is driven by a drive wheel 245 mounted on the axle 237. The wheel 245 is driven by a motor 246 attached to the holder 234. The drive connection comprises a pulley 247 mounted on the output shaft 248 of the motor 246 and a belt 249 connecting the pulley 247 and the wheel 245. A magnetic clutch 250 couples the wheel 245 with the wheel 239. The maximum torque transmitted by the clutch 250 is limited such that it is sufficient to push the topmost sheet 86 on the stack 60 up to the stop 57 but small enough that the front edge of the sheet does not buckle on the stop 57. This limit torque is adjusted by the width of the gap between the steel wheel 239 and the face of the permanent magnets 250 of the clutch. Two downholders 253 slightly press on the topmost sheet 86 by gravity to further assist in preventing buckling of that sheet.

The pivot axis 225 of the carrier 224 may be located at the upstream end of that carrier 224 rather than in its middle as shown in FIG. 10. An additional pair of transport rollers may be arranged between the conveyor 2 and the stack 60. These rollers would be mounted on horizontal axles which are perpendicular to the longitudinal extension of the guide rails 220.

In case the printer 1 outputs the sheets 86 with a relatively small spacing it may be advantageous to arrange an additional transport belt between the printer 1 and the conveyor 2 to increase the spacing between the sheets 86 such that sufficient time is available to switch the carrier 224 (FIG. 9) or the rail 20 (FIG. 2) from one to the other position between the last sheet 86 of one job and the next sheet 86 of the following job.

In FIG. 10 an additional switching device 258 is shown at the inlet end of the conveyor 2 comprising two parallel, spaced apart and interconnected plates 259 between which the sheets 86 are fed to the conveyor 2 in the illustrated normal position. The plates 259 can be pivoted around an axis 260 by an actuator (not shown) to a lowered position in which the sheets 86 are discarded into a trash bin 261. The axis 260 is at the upstream end of the plates 259. This switching device 258 may be advantageous in cases where the control unit controlling the operation of the stacker also starts and stops the printer 1. When a stop signal is sent to the printer 1, e.g. because of a paper jam on the conveyor 2 or in the stacker 3, the printer 1 may still eject a number of pages which already are in the print cycle. In such a case the switching device 258 is switched to the lower position simultaneously with the stop signal to the printer.

The transport mechanism 233 may advantageously also be used in other paper handling devices, e.g. different stackers than the ones described, e.g. a stacker according to U.S. Pat. No. 5,439,209 or a stacker without the feature of job separation or with a different one (longitudinal instead of transverse shift between successive documents).

What I claim is:

1. An apparatus for stacking printed documents consisting of at least one sheet of paper, the apparatus comprising:

a conveying means for conveying the sheets from an input end to an output end;

deflecting means associated with the conveying means for laterally deflecting the sheets as they pass from the input end to the output end, the deflecting means being switchable between two positions;

a stacker at the output end containing a sled vertically displaceable in vertical guide rails of a stand;

a first motor for lifting and lowering the sled;

a carriage pivotably mounted on the sled for pivoting about a horizontal axis;

a second motor for pivoting the carriage;

an exchangeable cassette inserted into the carriage, the cassette having a first removable horizontal plate, a rear wall and two opposite side walls;

a removable second horizontal plate insertable into the cassette and arrestable against the side walls at a plurality of levels; and a pusher mounted on the stand for pushing the inserted second plate against a stack of documents formed in said cassette.

2. The apparatus of claim 1, wherein the second plate in an initial position of the cassette is a top plate and has catch means for latching into one orifice of at least one row of orifices on each side wall.

3. The apparatus of claim 1, wherein the first motor has means for limiting its force onto the sled.

4. The apparatus of claim 1, wherein the deflecting means comprise an endless belt trained about two rollers which are rotatably mounted in a carrier which is pivotable about a substantially vertical axis between two pivot positions, and a lateral guide rail on each side of the belt, in one pivot position the belt converging towards one of the guide rails in transport direction and in the other pivot position towards the other guide rail.

5. The apparatus of claim 1 further comprising a transport wheel rotatably mounted on the stand and resting on the topmost sheet of the stack, the transport wheel being driven by a third motor, a drive connection between the third motor and the transport wheel comprising torque limiting means.

6. An apparatus for sorting printed documents consisting of at least one sheet of paper; the apparatus comprising:

a conveying means for conveying the documents;

a holder upstream of the conveying means;

a sled displaceably mounted in said holder for movement in a vertical direction;

a first motor for moving the sled;

an exchangeable cassette mounted in said sled, said cassette containing a stack of documents, the documents being separated from one another by a lateral shift between each successive document, successive shifts alternating such that the stack of documents within the cassette is substantially vertical;

lifting means with lifters that are movable on one side of the stack between the topmost document and the next lower document and thereby lift the topmost document;

a second motor for the lifting means for moving the lifters;

at least one pusher for pushing a lifted document to the conveying means;

a sensor connected to a controller for controlling the height position of the stack relative to the lifters.

7. The apparatus of claim 6, wherein the lifters comprise a lever attached to a substantially horizontal pivot axis and an arm attached to the lever and deflectable against the lever.

8. The apparatus of claim 6, wherein the cassette has side walls acting as guides as the documents are pushed out.

9. The apparatus of claim 6, wherein on each side of the cassette a separate pusher is provided actuated by separate actuators.

10. The apparatus of claim 6, wherein at least two sensors for controlling the height of the stack are mounted on the holder a first one of the sensors being mounted adjacent a first side wall of the cassette and a second one of the sensors being mounted adjacent a second side wall of the cassette.

11. An apparatus for sorting printed documents consisting of at least one sheet of paper, the apparatus comprising:

a conveyor for conveying the documents;

a holder upstream of the conveyor;

a sled displaceably mounted in said holder for movement in a vertical direction;

a first motor for moving the sled;

an exchangeable cassette mounted in said sled, said cassette being adapted to contain a stack of documents, the documents being separated from one another by a lateral shift between each successive document when said cassette is in use, successive shifts alternating such that the stack of documents within the cassette is substantially vertical;

a lifter element which in operation is movable on one side of the stack of documents from a first position outside of the topmost document to a second position in a first direction between the topmost document and the next lower document and thereby lift the topmost document;

a second motor for moving the lifter element;

at least one pusher for pushing a lifted document to the conveyor in a second direction which is perpendicular to the first direction; and a sensor connected to a controller for controlling the height position of the stack of documents relative to the lifter element.

* * * * *